US011174615B2

(12) United States Patent
Moss

(10) Patent No.: US 11,174,615 B2
(45) Date of Patent: Nov. 16, 2021

(54) LANDSCAPING WALLS, SYSTEMS AND METHODS

(71) Applicant: E.C. Manufacturing, LLC, Eau Claire, WI (US)

(72) Inventor: Matthew J. Moss, Augusta, WI (US)

(73) Assignee: E.C. Manufacturing, LLC, Eau Claire, WI (US)

( * ) Notice: Subject to any disclaimer, the term of this patent is extended or adjusted under 35 U.S.C. 154(b) by 0 days.

(21) Appl. No.: 16/868,198

(22) Filed: May 6, 2020

(65) Prior Publication Data

US 2020/0354916 A1 Nov. 12, 2020

Related U.S. Application Data

(60) Provisional application No. 62/844,577, filed on May 7, 2019.

(51) Int. Cl.
*E02D 29/02* (2006.01)

(52) U.S. Cl.
CPC ..... *E02D 29/0233* (2013.01); *E02D 29/0266* (2013.01); *E02D 2200/1685* (2013.01); *E02D 2250/00* (2013.01); *E02D 2300/0006* (2013.01); *E02D 2300/0007* (2013.01); *E02D 2300/0025* (2013.01); *E02D 2300/0053* (2013.01); *E02D 2600/30* (2013.01)

(58) Field of Classification Search
CPC .... E02D 2300/0006; E02D 2300/0007; E02D 2300/0025; E02D 2300/0054; E02D 2600/30
See application file for complete search history.

(56) References Cited

U.S. PATENT DOCUMENTS 3,316,721 A * 5/1967 Heilig ..... E02D 29/0241 405/262
3,785,606 A * 1/1974 Green ..... E02D 29/0266 249/3
4,407,611 A * 10/1983 Murray ..... E02D 29/0225 405/284
5,839,855 A * 11/1998 Anderson ..... E02D 29/0225 405/262
6,024,516 A * 2/2000 Taylor ..... E02D 29/02 405/262

(Continued)

OTHER PUBLICATIONS

PCT International Searching Authority, Notification of Transmittal of the International Search Report and Written Opinion of the International Searching Authority, or the Declaration, dated Sep. 9, 2020, p. 1-30, USA.

*Primary Examiner* — Benjamin F Fiorello
(74) *Attorney, Agent, or Firm* — Anthony J. Bourget

(57) ABSTRACT

Landscaping walls, systems and methods of manufacturing and installation of such walls include in aspects a fiberglass based wall having a decorative front side and a back side having at least one conduit where the conduit receives a cable or fastener extending outward from both ends of the conduit to connect to a stake to be inserted into ground adjacent the wall. The conduit in one aspect is a PVC tube mounted vertically against the wall and in aspects is embedded within the wall. The conduit allows for self-adjustment of the cable while also providing solid anchoring of the wall to prevent movement. The wall and system is lightweight, good looking and easy to install.

17 Claims, 8 Drawing Sheets

(56) References Cited

U.S. PATENT DOCUMENTS 6,269,606 B1 * 8/2001 McCown ..... E02D 5/74 52/741.13
6,447,212 B2 * 9/2002 Orsat ..... E02D 29/0241 405/262
7,086,811 B2 8/2006 Lewis
8,313,267 B2 11/2012 Johnson et al.
8,573,565 B1 11/2013 Lyndaker et al.
8,616,807 B2 * 12/2013 Ogorchock ..... E02D 29/02 405/262
8,720,160 B1 * 5/2014 Cooper ..... E04B 2/8629 52/745.12
8,985,900 B2 * 3/2015 Freitag ..... E02D 29/0225 405/107
2008/0313988 A1 12/2008 MacDonald
2010/0018146 A1 * 1/2010 Aube ..... E04F 13/147 52/483.1
2010/0247248 A1 * 9/2010 Taylor ..... E02D 5/76 405/262
2010/0310322 A1 * 12/2010 Taylor ..... E02D 29/0225 405/259.1
2011/0170957 A1 * 7/2011 Taylor ..... E02D 29/0233 405/262
2012/0073229 A1 * 3/2012 Castonguay ..... E02D 29/0233 52/426
2013/0142577 A1 * 6/2013 Nelson ..... E02D 29/0233 405/262
2014/0270991 A1 * 9/2014 Ogorchock ..... E02D 29/0233 405/286
2014/0314501 A1 * 10/2014 Usagani ..... E02D 29/0266 405/284
2015/0030394 A1 * 1/2015 Freitag ..... E02D 29/0233 405/284
2015/0125221 A1 * 5/2015 Kusuma ..... E02D 29/02 405/262
2016/0130780 A1 * 5/2016 Castonguay ..... E02D 29/0225 405/284
2016/0201288 A1 * 7/2016 Brodowski ..... C09D 175/02 405/302.4
2018/0044878 A1 * 2/2018 Lee ..... E02D 29/02
2018/0305883 A1 * 10/2018 Jarvie ..... E02D 17/18
2018/0347141 A1 * 12/2018 Ruel ..... E02D 29/0233
2019/0055706 A1 * 2/2019 Santha ..... E02B 3/106
2019/0055712 A1 * 2/2019 Smith ..... E02D 29/0241

* cited by examiner

LANDSCAPING WALLS, SYSTEMS AND METHODS

CROSS-REFERENCE TO RELATED APPLICATIONS

This application claims the benefit and priority of Provisional Patent Application Ser. No. 62/844,577, filed May 7, 2019 for LANDSCAPING WALLS, SYSTEMS AND METHODS, incorporated herein by reference in its entirety for continuity of disclosure.

BACKGROUND OF THE INVENTION

1. Field of the Invention

This invention relates to the field of landscaping wall devices, systems, and methods of manufacture and installation of landscaping walls.

2. Background Information

Landscaping walls, retaining walls, window wells or egress structures and other walls for landscaping purposes are common. Typically such walls are made of brick or wooden ties or other structural and land-supporting or retaining materials. Textured structures have been used which simulate or replicate the look and feel of natural stone or other types of retaining, landscaping or egress walls. A number of textured wall structures are made of plastic or fiberglass materials. While such walls or structure have benefits, there is room for improvement.

SUMMARY OF THE INVENTION

In one aspect the present invention pertains to a landscaping wall having a base wall having a front side and a back side, the base wall made of a composite material comprised of fiberglass, and at least one conduit positioned on the base wall at the back side and configured for receiving a cable through the conduit. In one aspect the conduit is embedding within the back side during manufacture of the wall. In other aspects a conduit may be added after creation of the wall or at intermediate steps in the formation of the wall. In further aspects the front side includes a molded decorative design which simulates landscaping materials. The wall is a unitary structure which appears to be a combination of multiple stone or brick elements for a natural look. In one aspect a conduit is formed within the backside of the wall, with the conduit positioned to have a vertical orientation. In one aspect the conduit is a PVC tube embedded against the back side of the wall, which receives a cable for connection to a stake to be inserted into the ground adjacent the wall for anchoring.

In a further aspect disclosed is a landscaping system comprising a base wall having a front side and a back side, the base wall made of a composite material comprised of fiberglass and including at least one conduit at the back side and having a first opening leading to a second opening, and a cable positioned in the at least one conduit such that a first end of the cable extends outward from the first opening and a second end of the cable extends outward from the second opening. The first side includes a decorative design simulating stone, brick or wood formed on the base wall. A stake passes through or connects to the cable to anchor the wall to the ground.

In a further aspect is disclosed a method of manufacture of a landscaping wall including positioning a conduit against a base wall and bonding the conduit to the base wall during a fiberglass application step. The conduit is oriented vertically in one aspect.

In a further aspect a method of installing a landscaping wall having a front side including a decorative design simulating stone, brick or wood, and a back side having a line passing through a conduit of the landscaping wall is disclosed, including positioning the landscaping wall on a surface and inserting a stake into the surface next to the landscaping wall, at least one end of the line connected to the stake. In further aspects opposite ends of the line are connected to the anchoring stake, and in yet further aspects multiple conduits and lines are used with multiple stakes to anchor the wall. Multiple walls may be connected together.

The above partial summary of the present invention is not intended to describe each illustrated embodiment, aspect, or every implementation of the present invention. The figures and detailed description and claims that follow more particularly exemplify these and other embodiments and further aspects of the invention.

Figure 1:
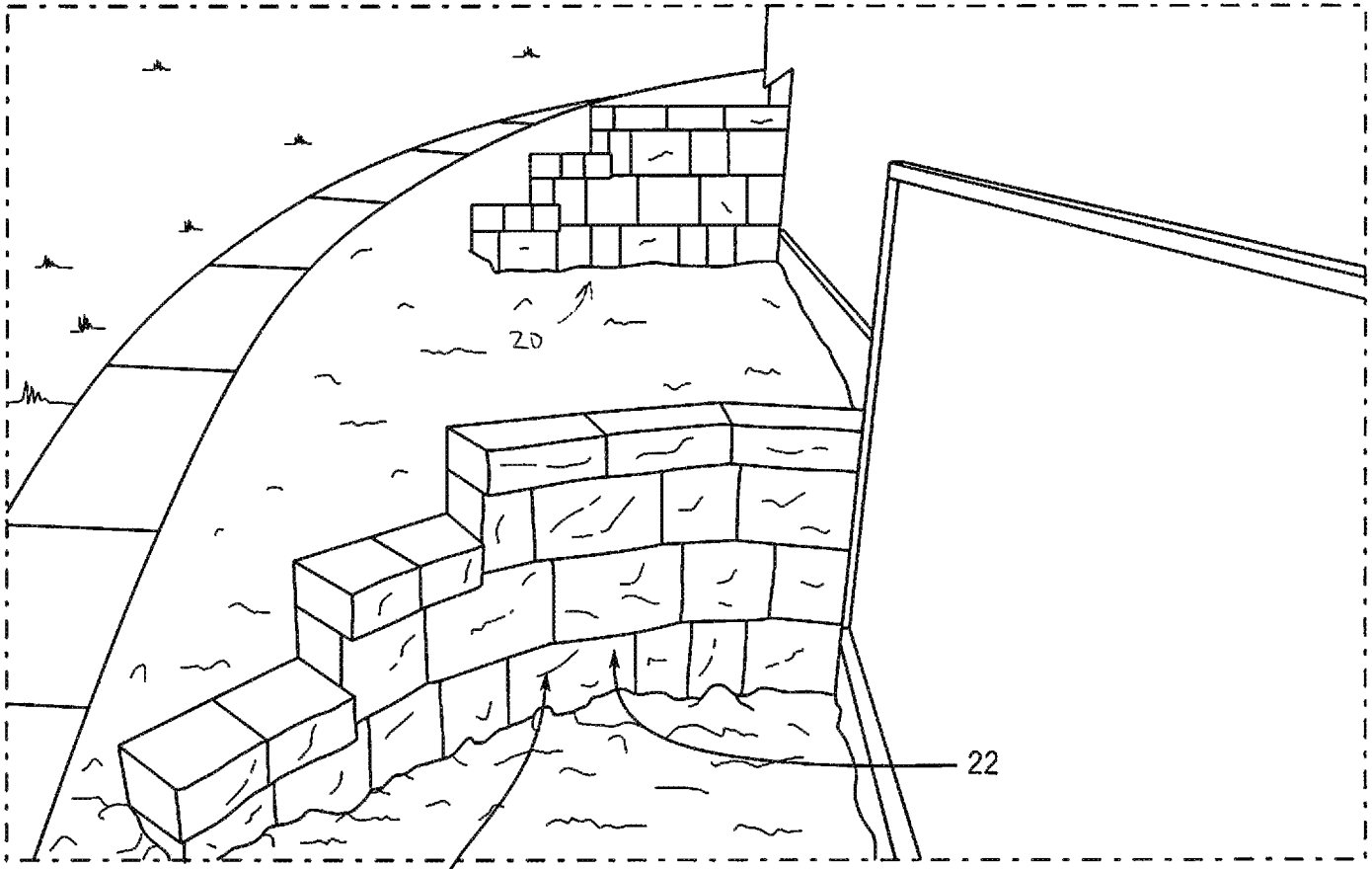
FIG. 1 is a perspective view of a wall in accordance with one aspect of the invention.

While the invention is amenable to various modifications and alternative forms, specifics thereof have been shown by way of example in the drawings and will be described in detail. It should be understood, however, that the intention is not necessarily to limit the invention to the particular embodiments, aspects and features described. On the contrary, the intention is to cover all modifications, equivalents, and alternatives falling within the spirit and scope of the invention and as defined by the appended claims.

DETAILED DESCRIPTION OF THE INVENTION

Referring to FIGS. 1-8, aspects of the landscaping walls, systems and methods are shown. FIG. 1 depicts a landscaping wall 20 installed adjacent a building. In the present case wall 20 is used in part as a retaining wall. Wall 20 includes a front side 22 which includes a molded decorative design simulating brick or rock. The design may also include simulated stone or lumber or other simulated materials. The wall 20 may be curved or straight and have stepped height or be of a uniform height.

Figure 2:
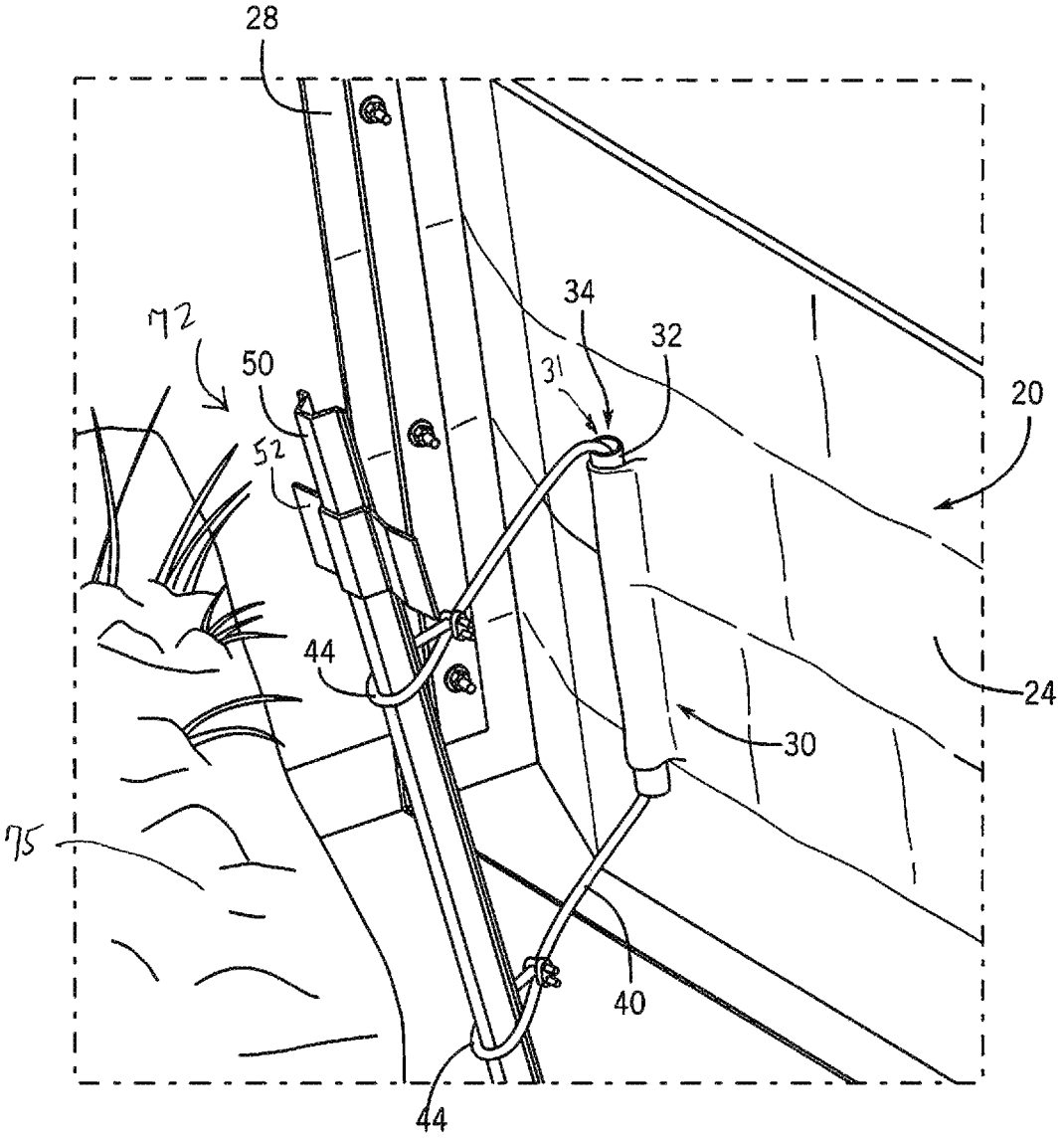
FIG. 2 is partial rear perspective view of the wall of FIG. 1 and further depicting system and method aspects.

FIG. 2 shows the wall 20 and a back side 24 containing a passageway 31. The passageway 31 is oriented generally vertically at the back side 24. In this example the passageway 31 is formed using a conduit 30. In one aspect conduit 30 includes a piece of PVC conduit 32. Conduit 30 may also be made of other materials. For instance, conduit 30 may be a flexible hose, such as a garden hose, or a cardboard tube or insert, or other object or filler material that allows for formation of a passageway 31. In one aspect a polyvinylchloride or PVC conduit 32 is positioned at the back of wall 20 and bonded to the wall 20 during fabrication of the wall 20. In one aspect the wall is fabricated in part by applying fiberglass and other materials. Several layers of fiberglass or other materials are used to form the wall 20 which is often cured within a mold in order to create a desired decorative pattern on the front side 22. In one aspect conduit 32 is embedded at the back side 24. Using fiberglass to embed conduit 32 provides a solid structural support. Multiple layers of fiberglass may be applied (for instance, by spraying) on the back side of wall 20, where the buildup of the fiberglass rigidly embeds the conduit 30 into the wall 20. Open opposite ends 34 of conduit 32 are left open during the manufacture and curing process (or are temporarily capped or plugged so the openings do not close during the fabrication process).

In one aspect the passageway 31 is formed by embedding a PVC conduit 32 into the fiberglass layer of the wall 20. In one aspect the PVC tube has a length of about 12 inches and diameter of ½ inches. Other lengths and sizes may be used. In one aspect where conduit 30 has a length of about 12 inches, a top portion of the conduit 30 will be positioned at least 4 inches from an uppermost portion of the wall 20, and a bottom portion of the conduit 30 will be positioned at least 4 inches from a lowermost portion of the wall. In other aspects, the distance between the conduit 30 and the upper or lowermost portions is between 8 and 9 inches. In a case where the total height of wall 20 measures 31 ½ inches, the conduit 30 may measure about 12 inches, leaving a gap of about 8 to 9 inches between the conduit 30 and the upper and lowermost portions of the wall. Various configurations or measurements of the gaps may be used depending on the case. Providing the conduit 30 in the middle portion (measured vertically) of the wall 20 as described (i.e., with gaps between the top and bottom edges) provides a desired structural advantage. Use of a rigid plastic such as PVC for the conduit 30 has a structural advantage also as compared to use of a cardboard tube or an angled cardboard bridge or other material. For instance, a folded cardboard, such as folded at 90 degrees may also be used as a tent-like structure to create a passageway along the back side 24. Such folded cardboard may also be layered with fiberglass to embed the cardboard within the layers and create a resulting passageway. Yet PVC has been found to work better for most purposes because the PVC conduit 30 will not tear (or most likely will not tear) when forces from the cable or line 40 are applied to the conduit 30. Use of a cardboard element to create the passageway will tend to result in tearing or potential tearing of the fiberglass due to forces applied by the cable 40. Moreover, utilizing a conduit 30 having a length of about 12 inches is desirable compared to, say a 4-inch-long variety, due to an increase strength and rigidity of affixing a longer length of PVC into the layers of fiberglass. Moreover, the 12-inch PVC allows for the cable to exit the passageway and connect to the stake 50 while applying angular forces originating at the respective ends of the conduit 30 having the relatively wider spacing of about 12 inches. This spacing of 12 inches also accommodates a more natural fixing to a strong middle region of the stake 50. The conduit 30 of about 12 inches allows for an improved distribution of the holding or resisting forces associated with the stake 50. In aspects, positioning the loops 40 of the cable 40 at about 12 inches to correspond to the length of the conduit 30 provides a desired structural or supporting benefit. Of course, conduit 30 having a length shorter or longer than about 12 inches is also contemplated for use.

Conduit 30 includes a passageway 31 through which a line 40, such as a rope or cable or wire or metal line passes. In one aspect line 40 is a metal cable having opposite ends 42 formed into loops 44.

Figure 3:
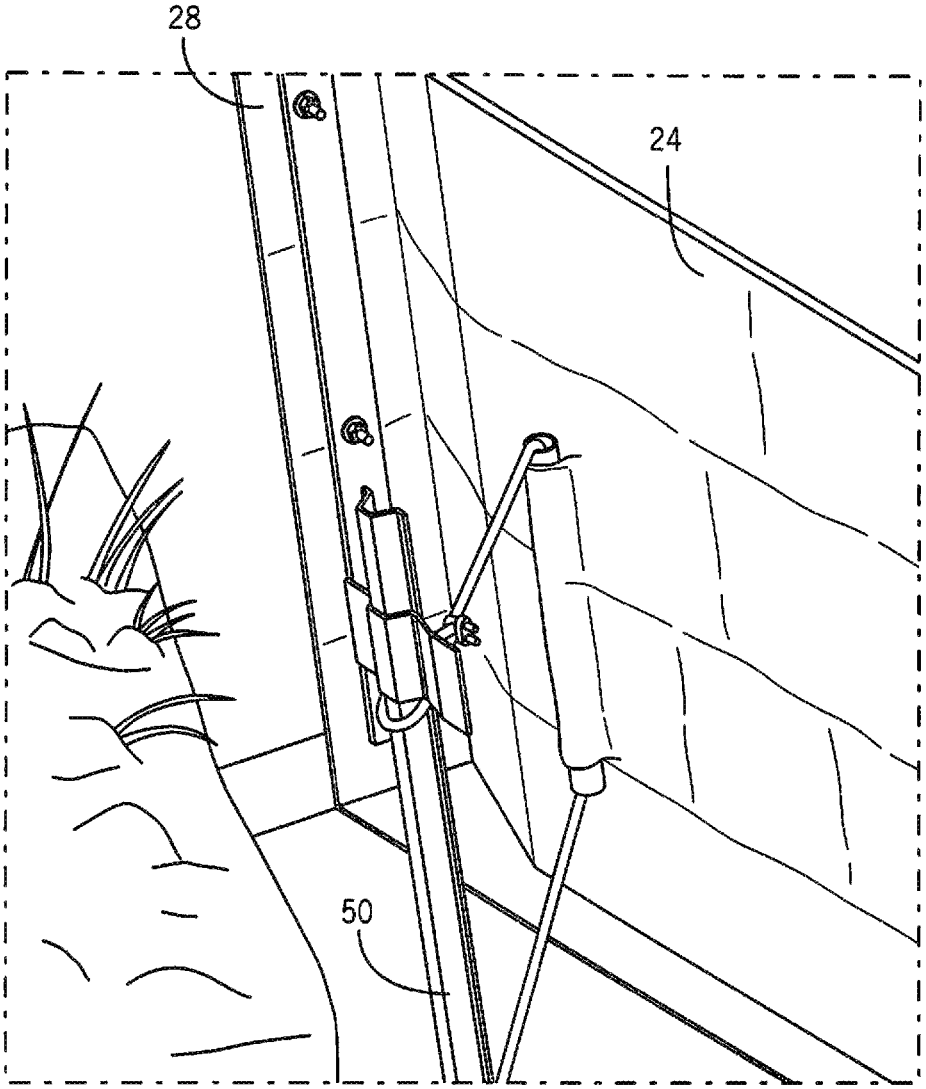
FIG. 3 is a partial rear perspective view of the wall, system and method aspects of FIG. 2.

As shown in FIG. 2 and FIG. 3, a stake 50 is inserted into respective loops 44 of line or cable 40 and the stake is pounded into the ground or surface 75 adjacent wall 20. Particularly, wall 20 is positioned at a desired depth with respect to a building, for instance. The ground upon which wall 20 is positioned is leveled. A gravel such as pea gravel inserted at the ground location to assist in leveling and for water draining. Gravel or other sand or soil is compacted as desired or as needed prior to application of wall 20 or for backfilling of wall 20. Stake 50 is inserted through respective loops 44 of cable 40 and pounded into the ground adjacent wall 20. As stake 50 is pounded, the cable 40 tightens or is otherwise secured into position so that wall 20 is also fixed into position, thus sufficiently and confidently anchoring wall 20. In one aspect stake 50 includes wings 52 upon which loops 40 catch. When pounding stake 50, the wings 52 pull downward on cable 40 to assist in tightly securing the cable 40 and setting the wall 20. While stake 50 shown in FIG. 2 depicts wings 52 at an upper portion of the stake 50, it may be appreciated that the stake 50 may be flipped upside-down so that the wings 52 are positioned closer to the ground when pounding the stake 50. In such case the wings 52 will catch the lower aspect of the cable 40 toward the ground for secure mounting. In further aspects, stake 50 will include fingers or hooks at a backside of the stake which catch the cable 40 so that cable 40 will not easily adjust or slide along the stake 50. In yet further aspects, the ability of the cable 40 to slide within passageway 31, allows for automatic self-adjustment of the cable 40 when pounding of the stake 50. The ability of the cable 40 to also slide along stake 50 in some instances also allows for automatic self-adjustment. FIG. 3 shows wings 52 of stake 50 securing cable 40 while cable 40 is pulled tight against conduit 30 to anchor the wall 20 to the ground and resist movement due to forces that will be applied to the wall 20.

Wall 20 may include multiple conduits 30 for like-anchoring along the length of the wall 20. In one aspect a wall 20 includes two conduits 30. In one aspect conduit 30 is oriented substantially vertically on back side 24 such that cable 40 passing through conduit 30 will also be oriented generally vertically. Such vertical orientation accommodates efficient securing of cable 40 to stake 50 and a strong anchoring force applied to wall 20. Conduit 30 may also be positioned horizontally or at other angles as desired, yet vertical orientation accommodates securing both ends of the line 40 with a single stake 50 (or the vertical configuration allows for a more efficient tightening of the cable when pounding the stake). The conduit 30 and line 40 are not visible from the front side 22. In one aspect conduit PVC 32 is removable. In further aspects PVC 32 is bolted or otherwise connected to wall 20.

Figure 4:
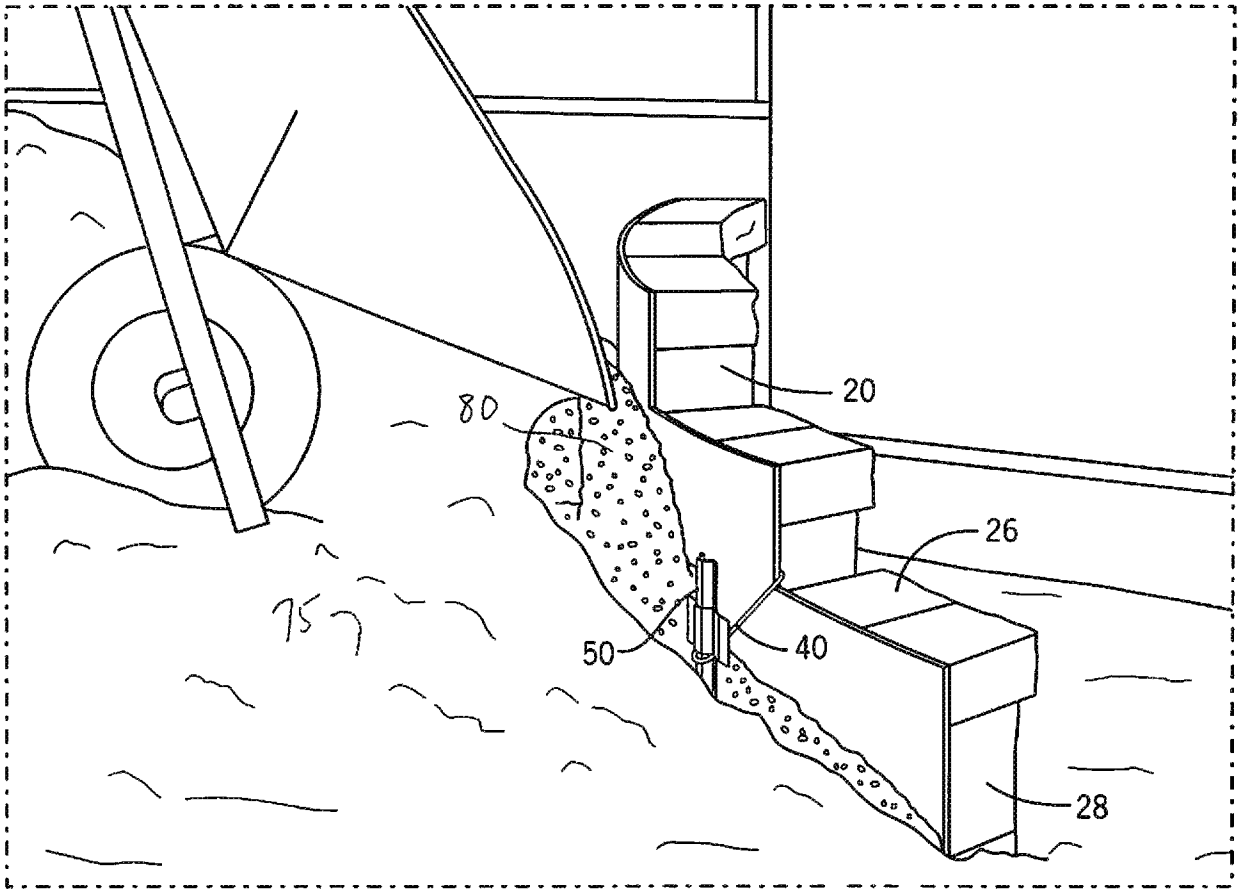
FIG. 4 is a partial rear perspective view of the wall, system and method aspects of FIG. 2.

FIG. 4 shows a backfill of soil 75 or gravel behind wall 20 and depicts stake 50 and cable 40 prior to being covered with gravel 80. Wall 20 includes a top flange 26 and opposite vertical mounting flanges 28. Mounting flanges 28 (also shown in FIG. 3) may include holes for securing wall 20 to a house or foundation of for connecting to another wall 20. Several walls 20 may thus be bolted together as desired. In one aspect a metal strip 60 or pair of strips 60 are used to reinforce mounting flanges 28. In one aspect strips 60 sandwich the flange 28 and include holes through which fasteners such as cement or other bolts pass and secure the flange 28 to a foundation or other wall 20.

Figure 5:
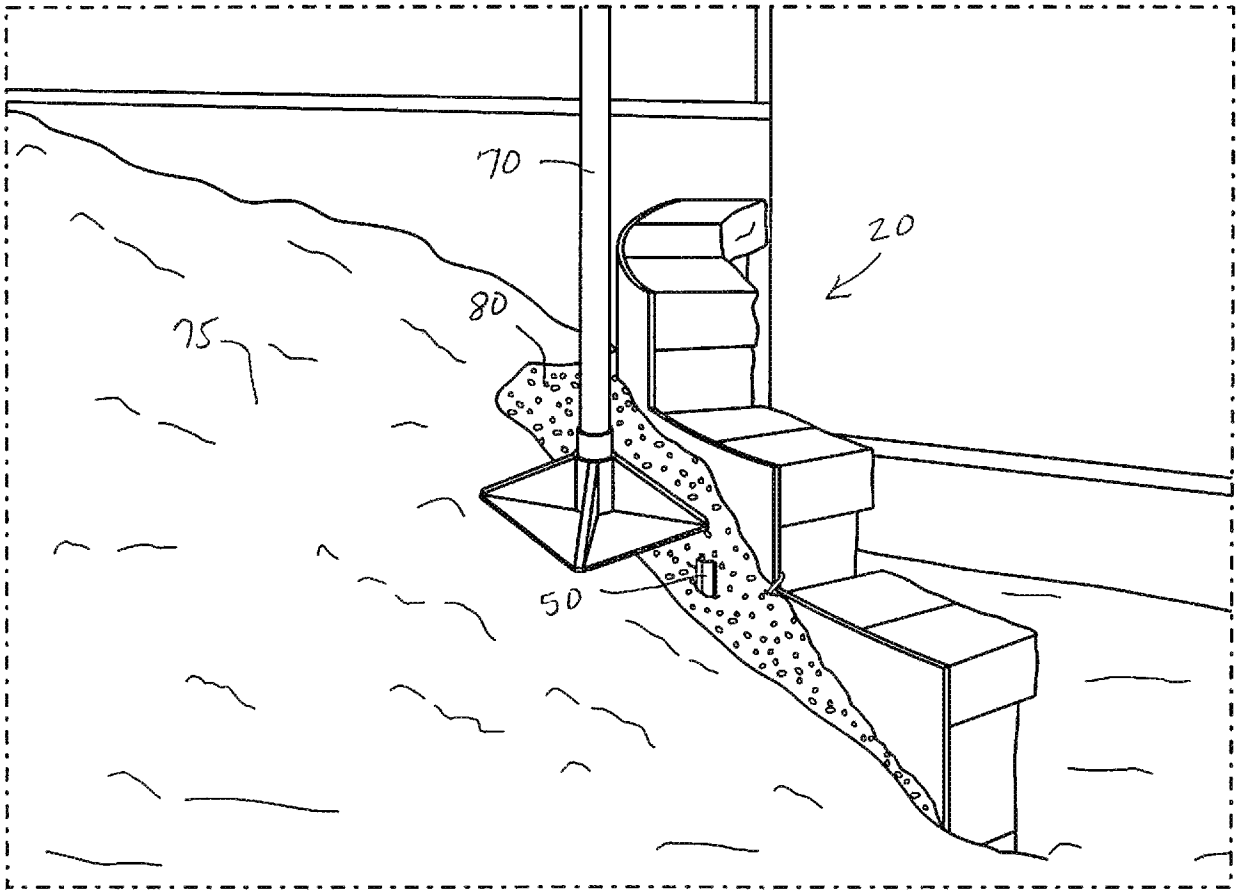
FIG. 5 is a partial rear perspective view of the wall, system and method aspects of FIG. 2.

FIG. 5 shows wall 20 having gravel and soil back filled to the back side 24 of wall. The soils may be compacted such as with a compactor 70. Additional landscape or topsoil or rocks or chips or other material is added for a finished look.

Figure 6:
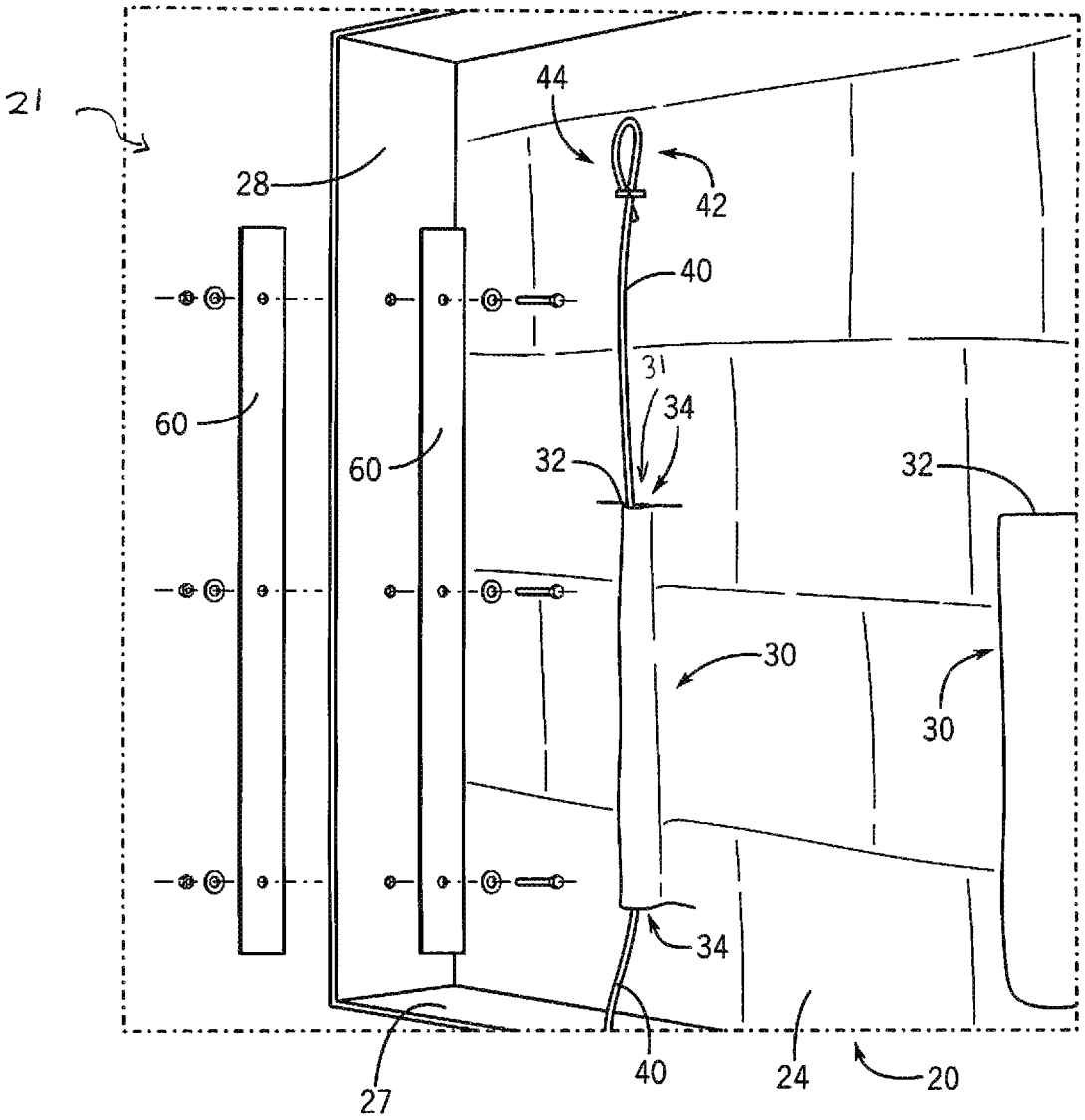
FIG. 6 is a partial rear perspective view an wall in accordance with alternative aspects.

FIG. 6 shows a further aspect of a straight wall 20 (without a curve as in FIG. 1) having conduit 30 embedded at back side 24. Cable or line 40 inserts through conduit 30 and has loops 44 at opposing ends and ready for insertion upon or otherwise connecting to a stake to be used to anchor wall 20. Strips 60 are used in conjunction with bolts, washers and nuts to reinforce mounting flange 28. A bottom flange 27 extends from a bottom of wall 20 and rearward of front side 22. Bottom flange 27 rests upon the ground surface which is leveled for placement of wall 20. Wall 20 is designed to stand upright on its own by resting upon bottom flange 27. The front side 22 includes the decorative design, and a portion or aspects of such design, although not entirely clear due to the bonding or fiberglass application process, are shown slightly in FIG. 6 at back side 24. In one aspect the PVC tube 32 has a length of about 10 to 24 inches depending on the desired size of wall 20, and in more particular aspects a length of about 12 inches, and in further aspects longer lengths, including lengths of 18 inches to 24 inches and a diameter of ½ inch. Different lengths and sizes may be used as desired or needed.

Figure 7:
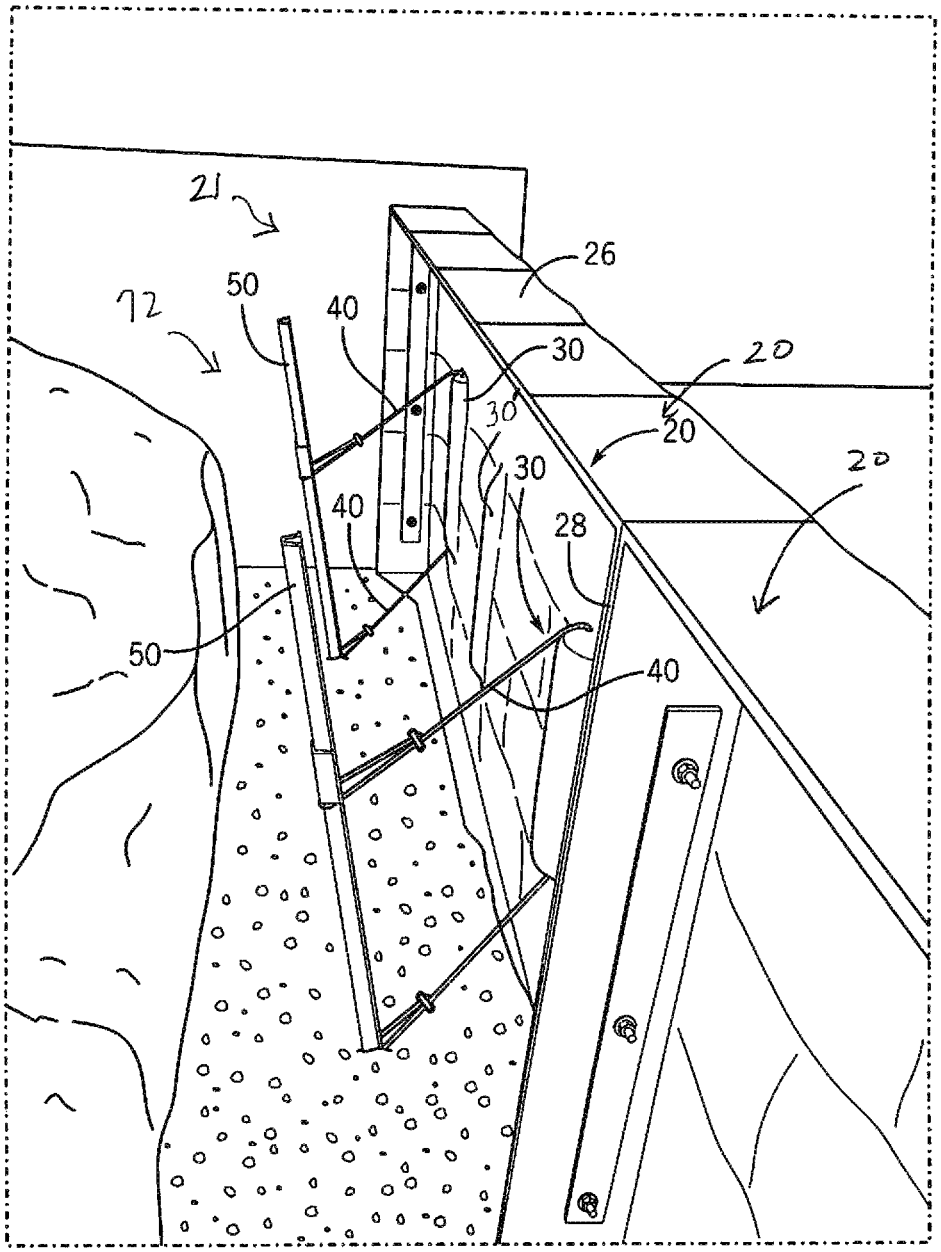
FIG. 7 is a rear perspective view of a wall, system and method in accordance with alternative aspects.

FIG. 7 shows a further aspect of the wall 20 and system 21 of the invention, including a pair of walls 20 connected together at mounting flange 28 and having a pair of conduits 30 positioned at back side 24. A pair of stakes 50 are used in conjunction with the pair of conduits 30 and lines 40 to anchor wall 20 to the ground. Top flange 26 and mounting flanges 28 may also include a decorative design. A trench 72 is dug (or already exists) into which wall 20 is positioned, and filled and leveled with sand or gravel or soil. Stakes 50 (and the back side 24 of wall 20) are back-filled with gravel and soils to secure walls 20 into position. As further presented, a first conduit 30 and second conduit 30 are positioned toward outside flanges 28 of the wall 20. Such positioning allows for anchoring the wall in a generally balanced manner and provides sufficient anchoring support. In addition to the first and second conduits 30, 30, a third conduit 30' may also be provided at back side 24 of wall 20 at a position between the first and second conduits 30, 30. This third conduit 30' provides additional structural integrity to the wall 20, even though it is not or might not be used for anchoring. Particularly, in one aspect the third conduit 30' is also embedded within a fiberglass layer of wall 20, yet lacks respective open ends. Conduit 30' may define a passageway 31, but such passageway is closed at both ends. Thus, in a situation where an installer purchases a wall 20 as a system or a kit (with instructions or with reference to online video instructions for installation), and the system or kit includes only two respective cables 40 and stakes 50 per wall 20, the user will not mistakenly install the cable 40 into an otherwise open third conduit 30'. Instead, the installer will utilize the open passageways of the respective first and second conduits 30 for a balanced anchoring. Of course, in some applications the third conduit 30' may also include an open passageway 31 for receipt of an anchor line. In further aspects, additional conduits 30, 30' may also be provided to a wall 20 for further anchoring and/or structural support.

Figure 8:
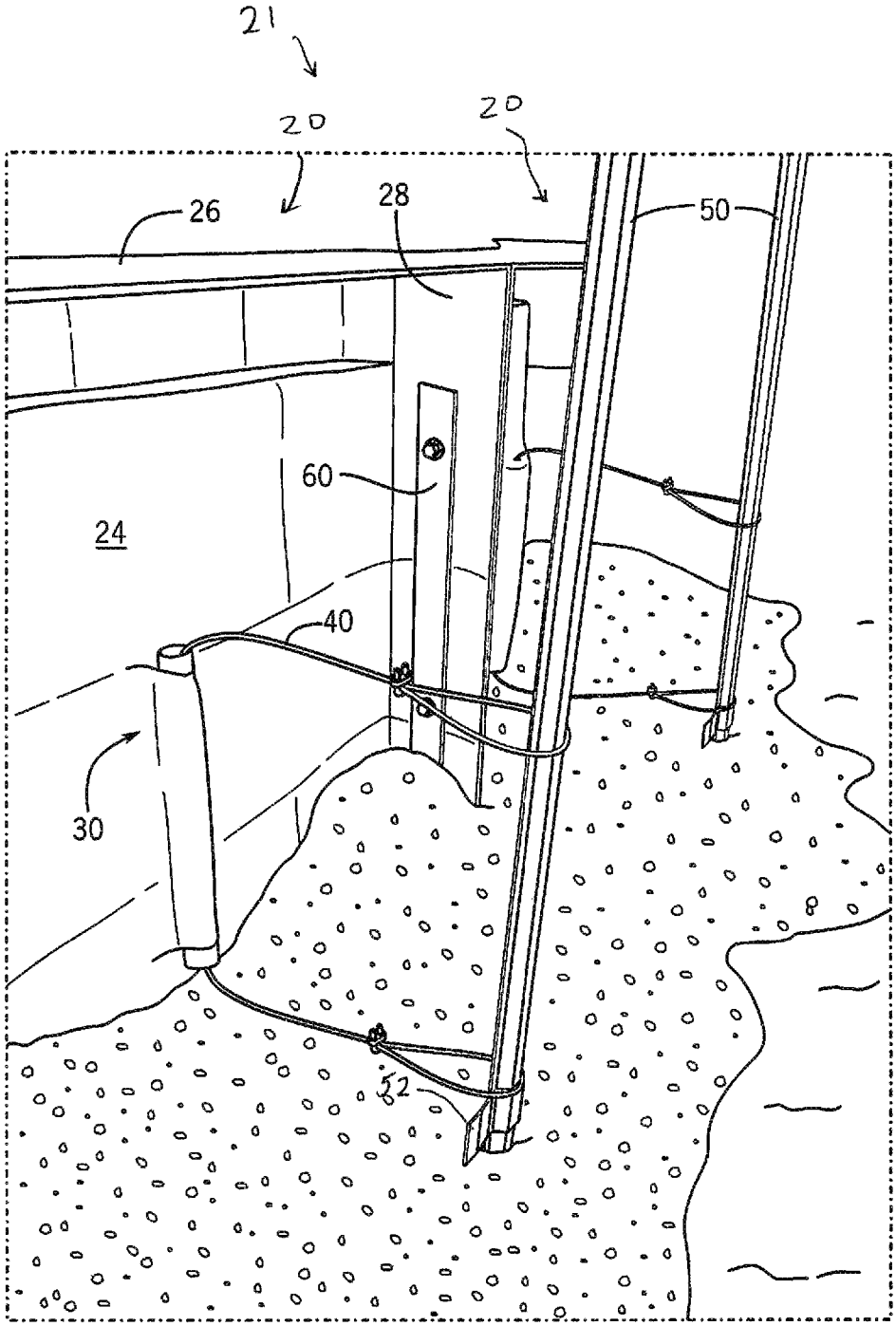
FIG. 8 is a partial rear perspective view of a wall, system and methods in accordance with alternative aspects.

FIG. 8 shows a pair of stakes 50 connected to lines 40 which extend from respective adjacent conduits 30. Stakes 50 may include wings 52 or clips or other mechanisms for further securing line 40 to stakes 50. While the cable 40 depicted in FIG. 8 is shown to be positioned above wing 52, in alternatives the cable 40 may be positioned below wing 52 so that it may be more effectively tightened when stake 50 is pounded downward into the ground. In one aspect cable 40 is a braided wire cable or a strap having a loop 44 or loops 44 created by wrapping the cable or strap upon itself and securing with a cable nut or connector.

In further aspects wall 20 is made of different materials (in addition to, or instead of, fiberglass) including, for instance, wood, metal, plastic or composites.

It should be understood, of course, that the foregoing relates to exemplary embodiments of the invention and that modifications may be made without departing from the spirit and scope of the invention as set forth in the following claims.

I claim:

1. A landscaping wall comprising:

a base wall having a front side and a back side, the base wall made of a fiberglass or plastic material and having a molded decorative design simulating stone or brick formed in the front side of the fiberglass or plastic material; and at least one enclosed, generally vertically oriented passageway located at the back side and having a first opening leading to a second opening of the enclosed passageway at the back side and configured to receive a cable therethrough, the passageway accessible solely from the back side, the passageway defined by a straight tube.

2. The landscaping wall of claim 1 where the passageway is defined by a conduit connected to the back side, the conduit defining the first opening and the second opening and configured such that a first end of a cable extends through the first opening and a second end of the cable extends through the second opening.

3. The landscaping wall of claim 1 further comprising a first conduit defining the passageway oriented vertically and positioned within a fiberglass layer of the back side, a second conduit defining a second passageway oriented vertically and positioned within the fiberglass layer of the back side, and a third conduit positioned between the first conduit and second conduit, the third conduit having opposite closed ends.

4. The landscaping wall of claim 1 where the landscaping wall is portable and the passageway has a length of at least 4 inches.

5. A landscaping wall comprising:

a base wall having a front side and a back side, the base wall made of a fiberglass or plastic material; and at least one passageway located at the back side and having a first opening leading to a second opening at the back side and configured to receive a cable therethrough, the passageway defined by a conduit connected to the back side, the conduit defining the first opening and the second opening and configured such that a first end of a cable extends through the first opening and a second end of the cable extends through the second opening, and where the conduit comprises a plastic tube embedded within a fiberglass layer of the back side, opposite ends of the plastic tube being open to form the first opening and the second opening.

6. The landscaping wall of claim 5 where the plastic tube includes a PVC conduit oriented vertically upon the landscaping wall.

7. The landscaping wall of claim 6 where the PVC conduit has a length of about 12 inches and is oriented such that a top portion of the conduit is positioned at least 4 inches downward of an uppermost portion of the landscaping wall and a bottom portion of the conduit is positioned at least 4 inches upward of a lowermost portion of the landscaping wall.

8. The landscaping wall of claim 5 where the front side includes a molded decorative design simulating stone or brick formed directly therein.

9. The landscaping wall of claim 5 where the front side includes a molded decorative design simulating stone, brick or wood, the passageway oriented vertically.

10. The landscaping wall of claim 9 further comprising a PVC conduit defining the passageway, a cable passing through the passageway, the cable having a first loop and a second loop, and a stake positioned through the first loop and the second loop.

11. A landscaping wall comprising:

a base wall having a front side and a back side, the base wall made of a fiberglass or plastic material; and at least one passageway located at the back side and having a first opening leading to a second opening at the back side and configured to receive a cable therethrough and further comprising opposing vertical mounting flanges positioned on opposite ends of the base wall extending rearward of the front side, and a top flange and a bottom flange extending rearward of the front side.

12. A landscaping system, comprising:

a base wall having a front side and a back side, the base wall made of a fiberglass or plastic material and having a molded decorative design simulating stone or brick formed in the front side of the fiberglass or plastic material and including at least one passageway defined by a straight tube at the back side having a first opening leading to a second opening at the back side; and a cable positioned in the at least one passageway such that a first end of the cable extends outward from the first opening and a second end of the cable extends outward from the second opening.

13. The landscaping system of claim 12 where the passageway is defined by a conduit connected to the base wall at the back side.

14. The landscaping system of claim 12 further comprising a stake which passes through a first loop of the cable and through a second loop of the cable, the stake configured to be positioned into the ground.

15. A method of manufacture of a landscaping wall, the method comprising:

positioning a conduit against a side of a base wall, the conduit having a top opening and a bottom opening and defining a passageway which is accessible solely from the side of the base wall; and bonding the conduit to the base wall during a fiberglass application step such that the top opening and the bottom opening remain open.

16. The method of claim 15 where the conduit is a length of PVC, the base wall having a front side, a back side, and a top flange extending rearward the front side, the passageway oriented vertically.

17. The method of claim 15 where the conduit is positioned at a back side of the landscaping wall, a front side of the landscaping wall having a decorative design simulating stone, brick or wood.

* * * * *